US010103492B2

(12) United States Patent
Ju

(10) Patent No.: US 10,103,492 B2
(45) Date of Patent: Oct. 16, 2018

(54) ELECTRICAL CONNECTOR WITH STABILIZING GROUNDING MEMBER

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/722,298

(22) Filed: Oct. 2, 2017

(65) Prior Publication Data

US 2018/0097314 A1 Apr. 5, 2018

Related U.S. Application Data

(60) Provisional application No. 62/404,395, filed on Oct. 5, 2016.

(30) Foreign Application Priority Data

Jan. 10, 2017 (CN) ..... 2017 2 0023446 U

(51) Int. Cl.
*H01R 13/646* (2011.01)
*H01R 13/04* (2006.01)
(Continued)

(52) U.S. Cl.
CPC ..... *H01R 13/646* (2013.01); *H01R 9/03* (2013.01); *H01R 13/04* (2013.01); *H01R 13/20* (2013.01);
(Continued)

(58) Field of Classification Search
CPC ..... H01R 13/6591; H01R 13/646
(Continued)

(56) References Cited

U.S. PATENT DOCUMENTS 6,945,796 B2 * 9/2005 Bassler ..... H01R 12/724 439/101
7,004,767 B2 * 2/2006 Kim ..... H01R 13/6585 439/607.01
(Continued)

FOREIGN PATENT DOCUMENTS

CN 101989696 A 3/2011
CN 202259956 U 5/2012
(Continued)

*Primary Examiner* — Tulsidas C Patel
*Assistant Examiner* — Peter G Leigh
(74) *Attorney, Agent, or Firm* — Locke Lord LLP; Tim Tingkang Xia, Esq.

(57) ABSTRACT

An electrical connector includes an insulating body, a shielding shell wrapping the insulating body to form an insertion space, and a first terminal group and a second terminal group fixed in an upper row and a lower row in the insulating body. The first terminal group and the second terminal group have multiple first terminals and multiple second terminals. Each first terminal and each second terminal are provided respectively with a first contacting portion and a second contacting portion. The first contacting portions and the second contacting portions are exposed in the insertion space. A ground member is arranged between two adjacent first terminals or two adjacent second terminals. The ground member has a third contacting portion. The third contacting portion only urges against the shielding shell.

19 Claims, 9 Drawing Sheets

(51) Int. Cl.

| | |
|---|---|
| ***H01R 13/648*** | (2006.01) |
| ***H01R 13/652*** | (2006.01) |
| ***H01R 13/6581*** | (2011.01) |
| ***H01R 24/60*** | (2011.01) |
| ***H01R 13/20*** | (2006.01) |
| ***H01R 13/6591*** | (2011.01) |
| ***H01R 9/03*** | (2006.01) |
| ***H01R 13/405*** | (2006.01) |
| ***H01R 13/631*** | (2006.01) |
| ***H01R 13/6594*** | (2011.01) |
| ***H01R 13/6597*** | (2011.01) |
| ***H01R 43/02*** | (2006.01) |

(52) U.S. Cl.
CPC ..... *H01R 13/405* (2013.01); *H01R 13/631* (2013.01); *H01R 13/6485* (2013.01); *H01R 13/652* (2013.01); *H01R 13/6581* (2013.01); *H01R 13/6591* (2013.01); *H01R 13/6594* (2013.01); *H01R 13/6597* (2013.01); *H01R 24/60* (2013.01); *H01R 43/0256* (2013.01)

(58) Field of Classification Search
USPC .... 439/660, 607.23, 607.01, 607.05, 607.07, 439/607.13, 607.27, 607.28
See application file for complete search history.

(56) References Cited

U.S. PATENT DOCUMENTS

| | | | | |
|---|---|---|---|---|
| 7,690,948 | B2 * | 4/2010 | Lung | H01R 13/41 439/607.27 |
| 7,699,663 | B1 * | 4/2010 | Little | H01R 13/6471 439/660 |
| 7,845,965 | B2 * | 12/2010 | Ko | H01R 4/023 439/352 |
| 8,968,031 | B2 | 3/2015 | Simmel et al. | |
| 9,312,644 | B2 * | 4/2016 | Kao | H01R 13/6591 |
| 9,450,339 | B2 * | 9/2016 | Gao | H01R 13/6582 |
| 9,484,680 | B2 * | 11/2016 | Davuluri | H01R 13/6597 |
| 2005/0026500 | A1 * | 2/2005 | Ji | H01R 13/6582 439/607.01 |
| 2009/0325417 | A1 * | 12/2009 | Ko | H01R 4/023 439/350 |
| 2015/0011130 | A1 * | 1/2015 | Wang | H01R 13/193 439/660 |
| 2015/0222059 | A1 * | 8/2015 | Little | H01R 13/6587 439/607.55 |
| 2015/0244111 | A1 * | 8/2015 | Ju | H01R 13/6585 439/607.05 |
| 2016/0149350 | A1 * | 5/2016 | Kao | H01R 12/724 439/607.05 |
| 2016/0172791 | A1 * | 6/2016 | Fan | H01R 13/6585 439/607.05 |
| 2016/0285209 | A1 * | 9/2016 | Peng | H01R 13/6585 |
| 2016/0380386 | A1 * | 12/2016 | Kong | H01R 13/6485 439/607.01 |

FOREIGN PATENT DOCUMENTS

| | | |
|---|---|---|
| CN | 205070058 U | 3/2016 |
| CN | 205122849 U | 3/2016 |

* cited by examiner

ELECTRICAL CONNECTOR WITH STABILIZING GROUNDING MEMBER

CROSS-REFERENCE TO RELATED APPLICATION

This application claims priority and the benefit of U.S. Provisional Application No. 62/404,395, filed on Oct. 5, 2016, the entire contents of which are hereby incorporated by reference.

FIELD OF THE INVENTION

The present invention relates to an electrical connector, and more particularly to an electrical connector capable of reducing electromagnetic interference.

BACKGROUND OF THE INVENTION

With the development of electronic technology, the frequency and speed of signals transmitted by an electrical connector tend to be higher. Therefore, the requirement for a shielding structure of the electrical connector is higher. It is required that the shielding structure have a higher and more stable grounding effect, so as to meet that the requirement of modern society for a high-frequency transmission performance of the electronic connector can be met.

An existing electrical connector with a shielding structure includes an insulating body, and multiple signal terminals and at least one ground terminal disposed in the insulating body. The ground terminal has a fixing portion and a soldering portion extending backward from the fixing portion. The fixing portion is fixed on the insulating body. The soldering portion is soldered onto a circuit board for grounding. A shielding shell is sleeved over the insulating body, and is configured to shield outside signal interference on the signal terminals, and thereby the shielding structure is formed.

However, since the soldering portion is only soldered onto the circuit board for grounding, if the soldering portion is soldered poorly or gets loose, the signal transmission of the signal terminals will be affected, and as a result, the high-frequency transmission performance of the electrical connector will be affected.

Therefore, a heretofore unaddressed need exists in the art to address the aforementioned deficiencies and inadequacies.

SUMMARY OF THE INVENTION

In one aspect, the present invention relates to an electrical connector capable of reducing electromagnetic interference. By arranging a ground member in the electrical connector to urge against a shielding shell to form grounding, the grounding effect of the electrical connector is enhanced.

In certain embodiments, an electrical connector is used for the insertion of a mating connector. The electrical connector includes an insulating body, a shielding shell wrapping the insulating body to form an insertion space, and a first terminal group and a second terminal group respectively fixed in an upper row and a lower row in the insulating body. The insertion space is configured for the insertion of the mating connector. The first terminal group and the second terminal group are provided respectively with multiple first terminals and multiple second terminals. Each of the first terminals and of the second terminals respectively have a first contacting portion and a second contacting portion. The first contacting portions and the second contacting portions are exposed in the insertion space. A ground member is arranged between two adjacent first terminals or two adjacent second terminals. The ground member is correspondingly arranged in a row along with the multiple first terminals or the ground member is arranged in a row along with the multiple second terminals. The ground member has a third contacting portion, and the third contacting portion only urges against the shielding shell.

In certain embodiments, the insulating body is provided with a through hole. The third contacting portion is exposed in the through hole. A first elastic piece extends into the insertion space from the shielding shell, and the first elastic piece is located in the through hole and urges against the third contacting portion.

In certain embodiments, the third contacting portion is formed by upwardly raising from the ground member, and the third contacting portion upwardly or downwardly goes beyond the first terminal group or the second terminal group.

In certain embodiments, reserved terminals, power terminals, differential pair terminals and ground terminals are arranged respectively in sequence on both sides of the ground member, and the reserved terminals are adjacent to the ground member.

In certain embodiments, the width of the ground member is greater than or equal to the sum of the widths of the two first terminals or the sum of the widths of the two second terminals.

In certain embodiments, the ground member is fixed in the insulating body and is not exposed in the insertion space.

In certain embodiments, two front pins extend forward from the third contacting portion of the ground member, two rear pins extend backward from the third contacting portion of the ground member, the front pins do not extend forward out of the insulating body, and each rear pin is provided with a third soldering portion that extends backward out of the insulating body.

In certain embodiments, the insulating body is provided with a base. Each first terminal has a first soldering portion that extends out of the base, each second terminal has a second soldering portion that extends out of the base, and the third soldering portions are located between two adjacent first soldering portions or two adjacent second soldering portions. Correspondingly, the third soldering portions are arranged in a row along with the multiple first soldering portions or the third soldering portions are arranged in a row along with the multiple second soldering portions.

In certain embodiments, the insulating body is provided with a base, a stopping portion extends toward the base from the shielding shell, the base is concavely provided with a positioning slot corresponding to the stopping portion, and the stopping portion is located in the positioning slot.

In certain embodiments, the insulating body is provided with a base. An upper board and a lower board extend from one side of the base, and the upper board and the lower board are located in the insertion space. The first contacting portions are exposed downwardly at the upper board, and the second contacting portions are exposed upwardly at the lower board.

In certain embodiments, the front ends of the upper board and the lower board are provided respectively with at least one hole, and the holes communicate with the insertion space. At least one shielding plate is respectively exposed upwardly at the upper board and exposed downwardly at the lower board, and the shielding plate is provided with at least one second elastic piece that runs through the hole and is exposed in the insertion space.

In certain embodiments, the shielding plate is located between two adjacent second elastic pieces and pierced, so that a contacting arm which extends backward is formed, and the contacting arm urges against the shielding shell.

In certain embodiments, the shielding plate is concavely provided with an accommodating slot, and an insulating sheet is located in the accommodating slot.

In certain embodiments, a middle shielding sheet is located between the first terminal group and the second terminal group, and is provided with a main body portion. Two buckling arms extend from both sides of the main body portion and are located on both sides of the insulating body. A hooking portion transversely extends from the front end of each buckling arm and is exposed in the insertion space.

In certain embodiments, the insulating body is provided with a base, a tongue extends from one side of the base, the first contacting portions are exposed upwardly at the tongue, and the second contacting portions are exposed downwardly at the tongue. The base is provided with a groove, and the third contacting portion is exposed in the groove and urges against the shielding shell.

Compared with the related art, certain embodiments of the present invention arrange the ground member between the two adjacent first terminals or the two adjacent second terminals, the ground member is provided with the third contacting portion, the third contacting portion only urges against the shielding shell, consequently, a ground portion is added, the grounding area is enlarged, the grounding effect of the electrical connector is enhanced, electromagnetic interference is decreased, and the high-frequency transmission performance of the electrical connector is guaranteed.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
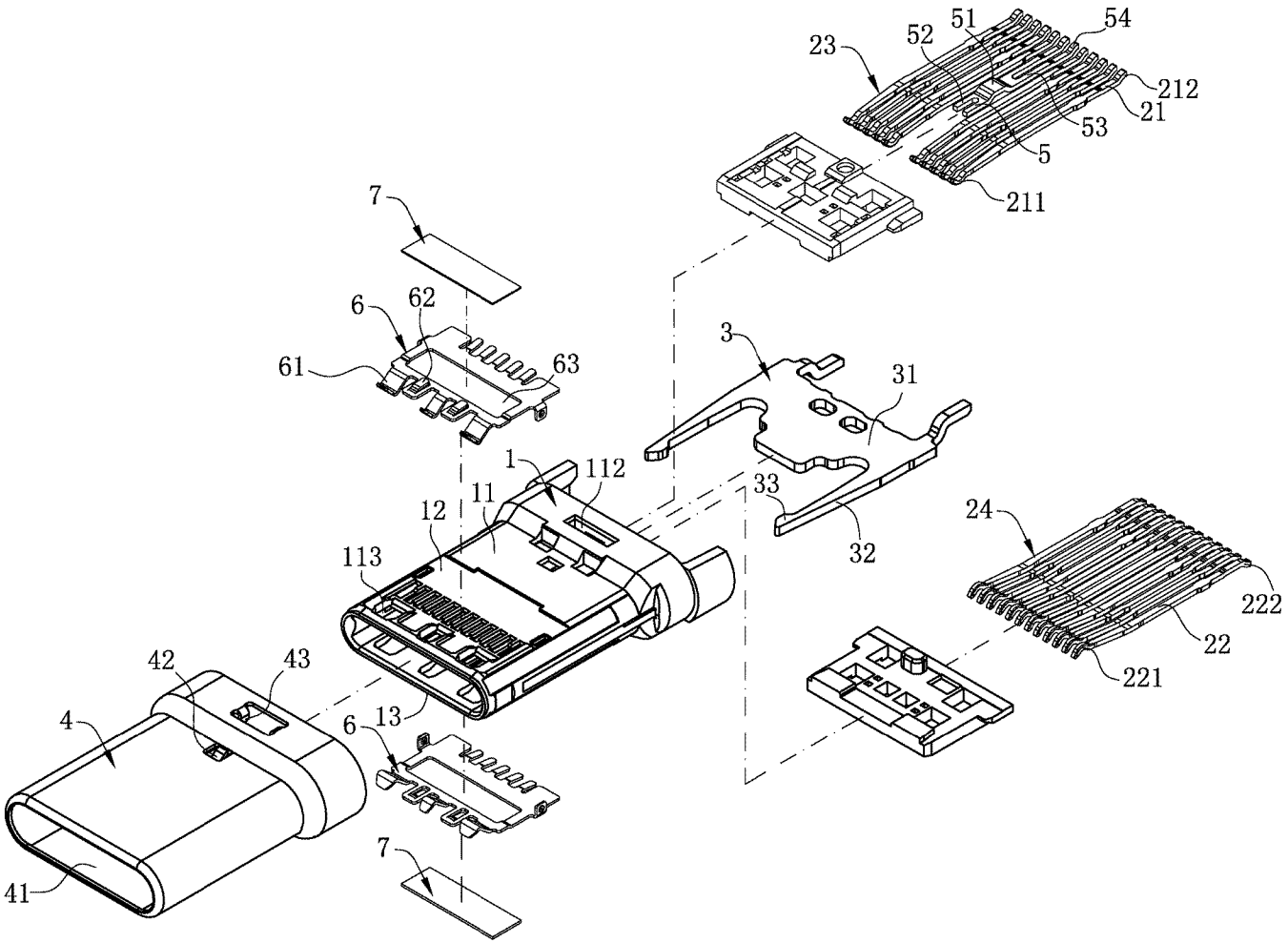
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector that is used for the insertion of a mating connector. The electrical connector includes an insulating body 1, a first terminal group 23, a second terminal group 24 and a middle shielding sheet 3 fixed in the insulating body 1, a shielding shell 4 sleeved over the insulating body 1 to form an insertion space 41, and a ground member 5 only urges against the shielding shell 4.

Figure 2:
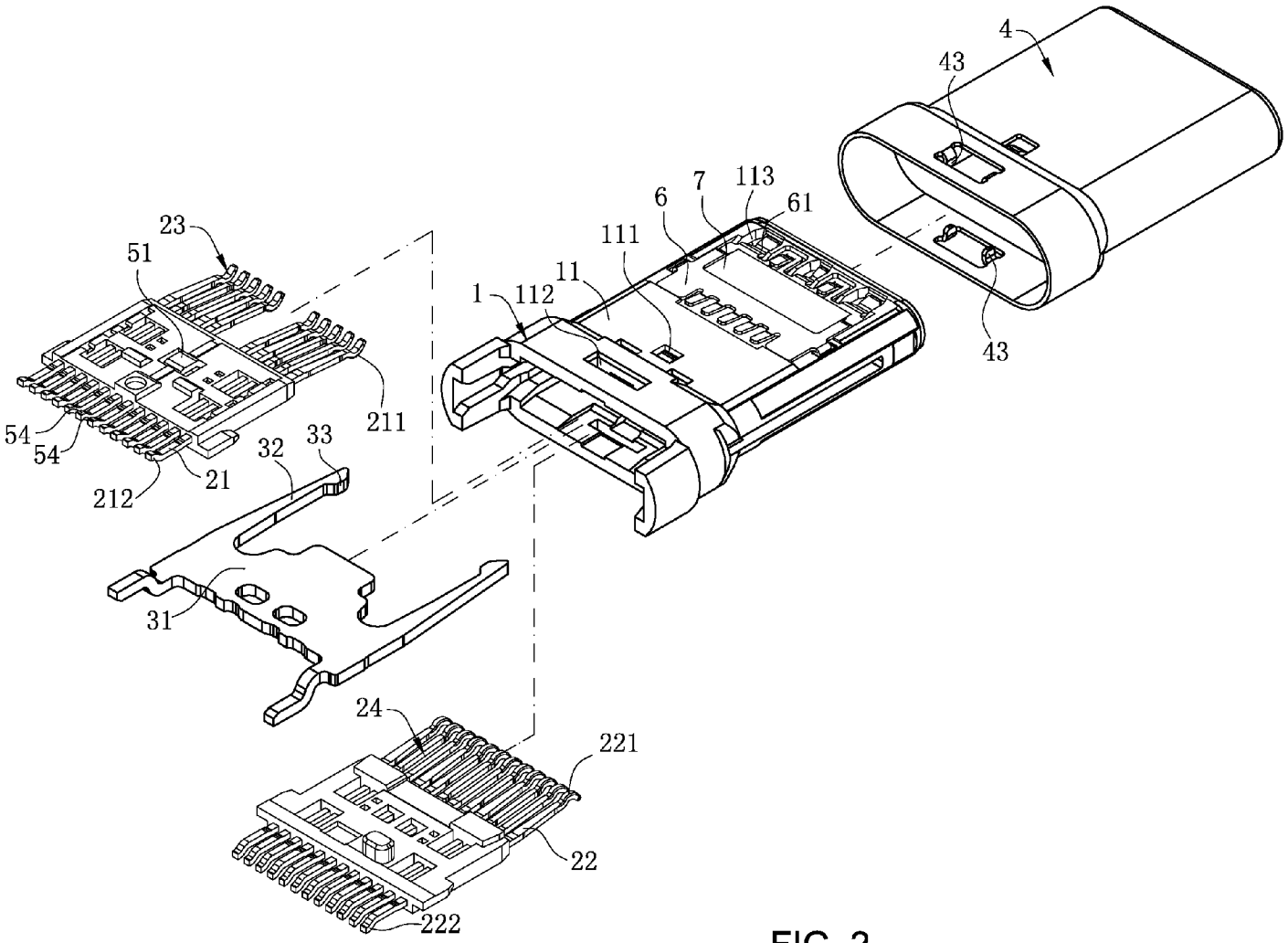
FIG. 2 is a schematic three-dimensional exploded view of the electrical connector according to one embodiment of the present invention from another angle.

FIGS. 1 and 2 show a first embodiment of the present invention. The insulating body 1 has a base 11, and an upper board 12 and a lower board 13 located at one side of the base 11. The insulating body 1 is concavely provided with a through hole 111 in the base 11. The base 11 is concavely provided with a positioning slot 112. The upper board 12 and the lower board 13 are located in the insertion space 41. The front ends of the upper board 12 and the lower board 13 are provided respectively with three holes, and the holes communicate with the insertion space 41.

The first terminal group 23 and the second terminal group 24 are provided respectively with multiple first terminals 21 and multiple second terminals 22. Each first terminal 21 and each second terminal 22 are provided respectively with a first contacting portion 211 and a second contacting portion 221, and the first contacting portions 211 and the second contacting portions 221 are exposed in the insertion space 41. Each first terminal 21 is provided with a first soldering portion 212 that extends out of the insulating body 1, and each second terminal 22 is provided with a second soldering portion 222 that extends out of the insulating body 1.

Figure 3:
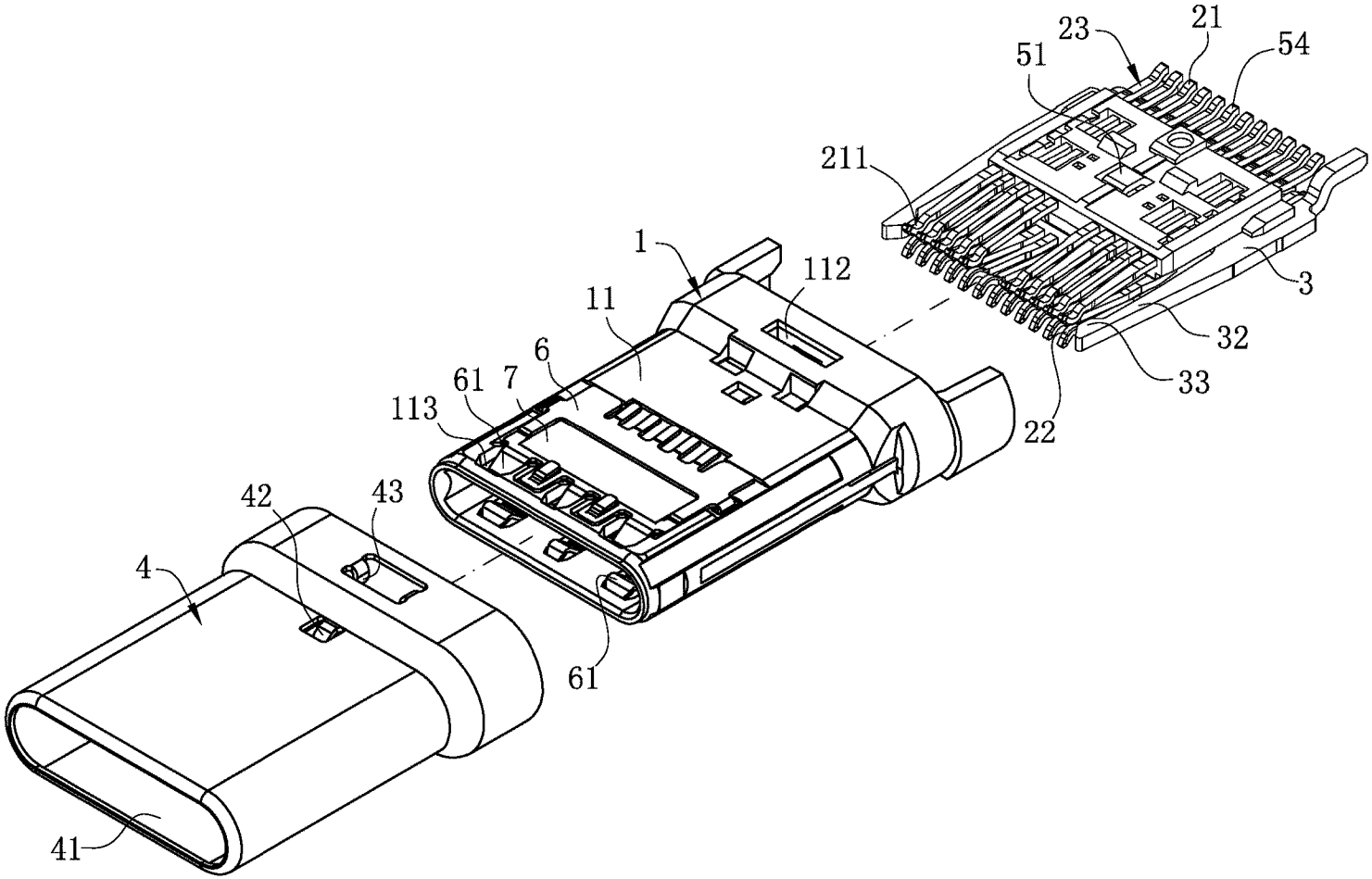
FIG. 3 is a schematic three-dimensional exploded view of the electrical connector according to one embodiment of the present invention from another angle.

As shown in FIGS. 1-3, the ground member 5 is located between two adjacent first terminals 21 or two adjacent second terminals 22. Correspondingly, the ground member 5 is arranged in a row along with the first terminals 21 or the ground member 5 is arranged in a row along with the second terminals 22. A third contacting portion 51 is formed by protruding upward from the ground member 5. The third contacting portion 51 goes upward or downward goes beyond the first terminal group 23 or the second terminal group 24, and the third contacting portion 51 is exposed in the through hole 111. Reserved terminals, power terminals, differential pair terminals and ground terminals are arranged respectively in sequence on both sides of the ground member 5. The reserved terminals are adjacent to the ground member 5. The width of the ground member 5 is greater than or equal to the sum of the widths of the two first terminals 21 or the sum of the widths of the two second terminals 22. The ground member 5 is fixed in the insulating body 1 and is not exposed in the insertion space 41, and the ground member 5 is not mated with the mating connector. Two front pins 52 extend forward from the third contacting portion 51 of the ground member 5. Two rear pins 53 extend backward from the third contacting portion 51 of the ground member 5. The front pins 52 do not extend forward out of the insulating body 1. Each rear pin 53 is provided with a third soldering portion 54 that extends backward out of the insulating body 1. The third soldering portions 54 are located between two adjacent first soldering portions 212 or two adjacent second soldering portions 222. Correspondingly, the third soldering portions 54 are arranged in a row along with the multiple first soldering portions 212 or the third soldering portions 54 are arranged in a row along with the multiple second soldering portions 222.

Figure 4:
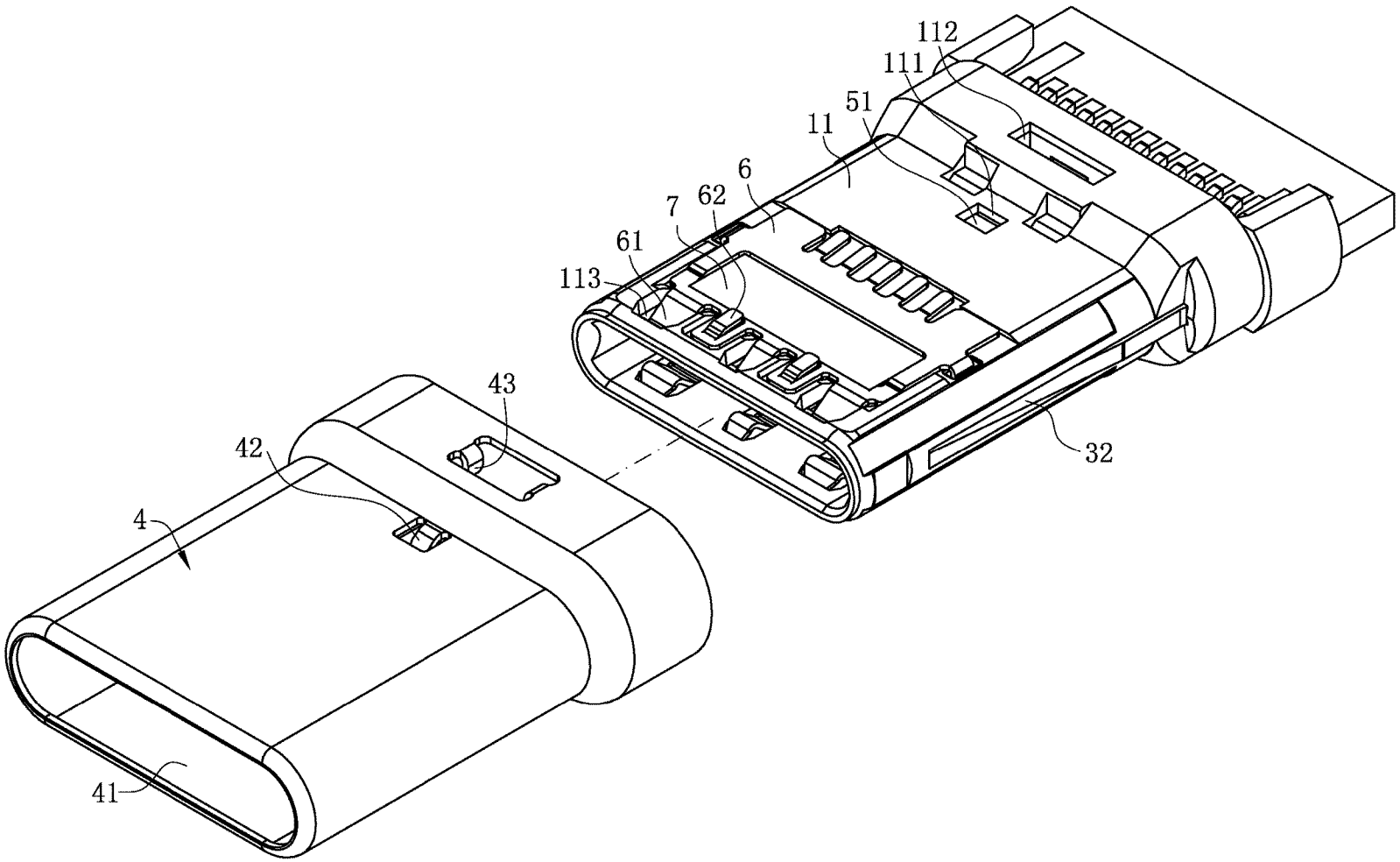
FIG. 4 is a schematic three-dimensional partial assembly view of the electrical connector according to one embodiment of the present invention.

As shown in FIG. 4, two shielding plates 6 are respectively exposed upward at the upper board 12 and exposed downward at the lower board 13. Each shielding plate 6 is provided with three second elastic pieces 61. The second elastic pieces 61 run through the holes and are exposed in the insertion space 41. Each shielding plate 6 is pierced between each two adjacent second elastic pieces 61, so that a contacting arm 62 which extends backward is formed. The contacting arms 62 urge against the shielding shell 4. Each shielding plate 6 is concavely provided with an accommodating slot 63, and two insulating sheets 7 are located respectively in the accommodating slots 63, and are located between the upper board 12 and the shielding shell 4 or between the lower board 13 and the shielding shell 4.

A middle shielding sheet 3 is located between the first terminal group 23 and the second terminal group 24, and is provided with a main body portion 31. Two buckling arms 32 extend from both sides of the main body portion 31 and are located on both sides of the insulating body 1. A hooking portion 33 transversely extends from the front end of each buckling arm 32 and is exposed in the insertion space 41.

Figure 5:
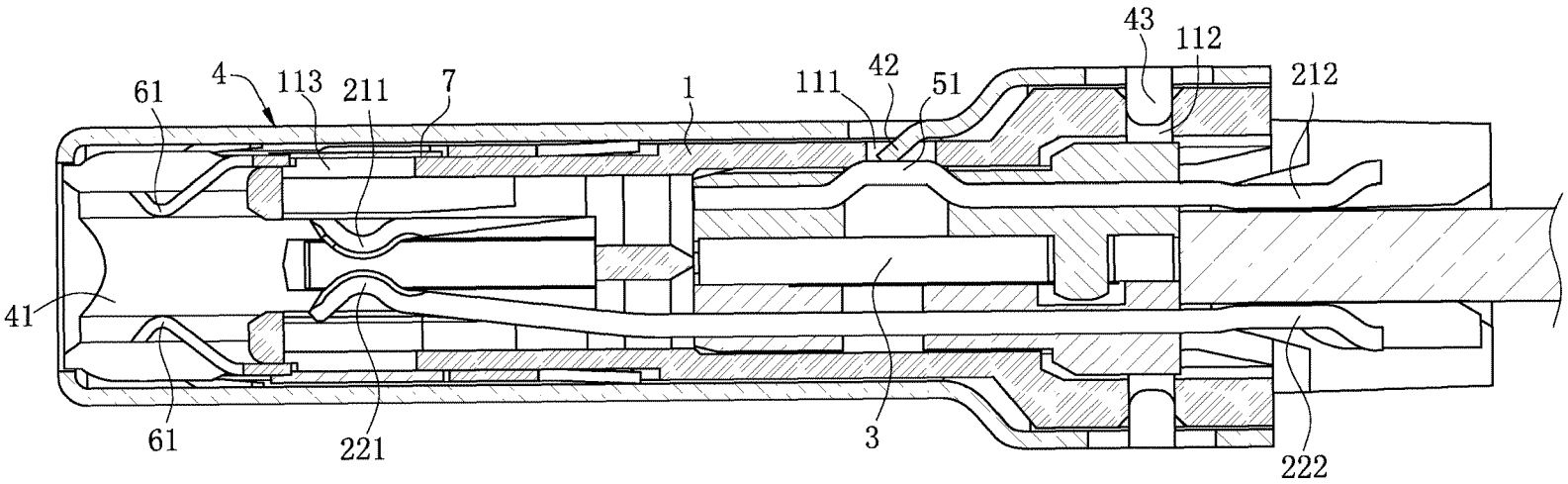
FIG. 5 is a local sectional view of the electrical connector according to one embodiment of the present invention.

As shown in FIG. 5, a first elastic piece 42 extends into the insertion space 41 from the shielding shell 4, and the first elastic piece 42 is located in the through hole 111 and urges against the third contacting portion 51. A stopping portion 43 extends toward the base 11 from the shielding shell 4, and the stopping portion 43 is located in the positioning slot 112.

Figure 6:
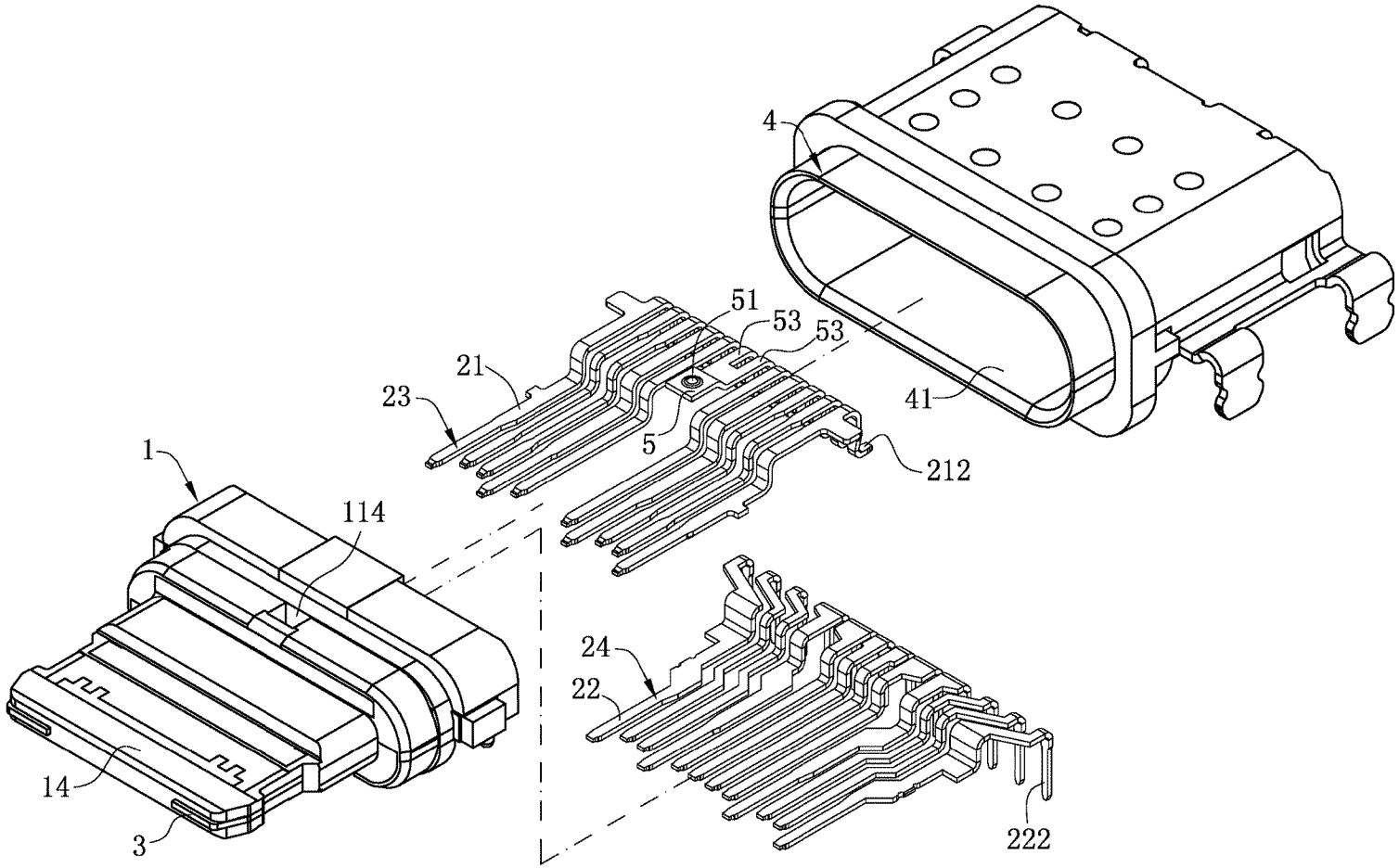
FIG. 6 is a schematic three-dimensional exploded view of an electrical connector of a second embodiment of the present invention.
Figure 7:
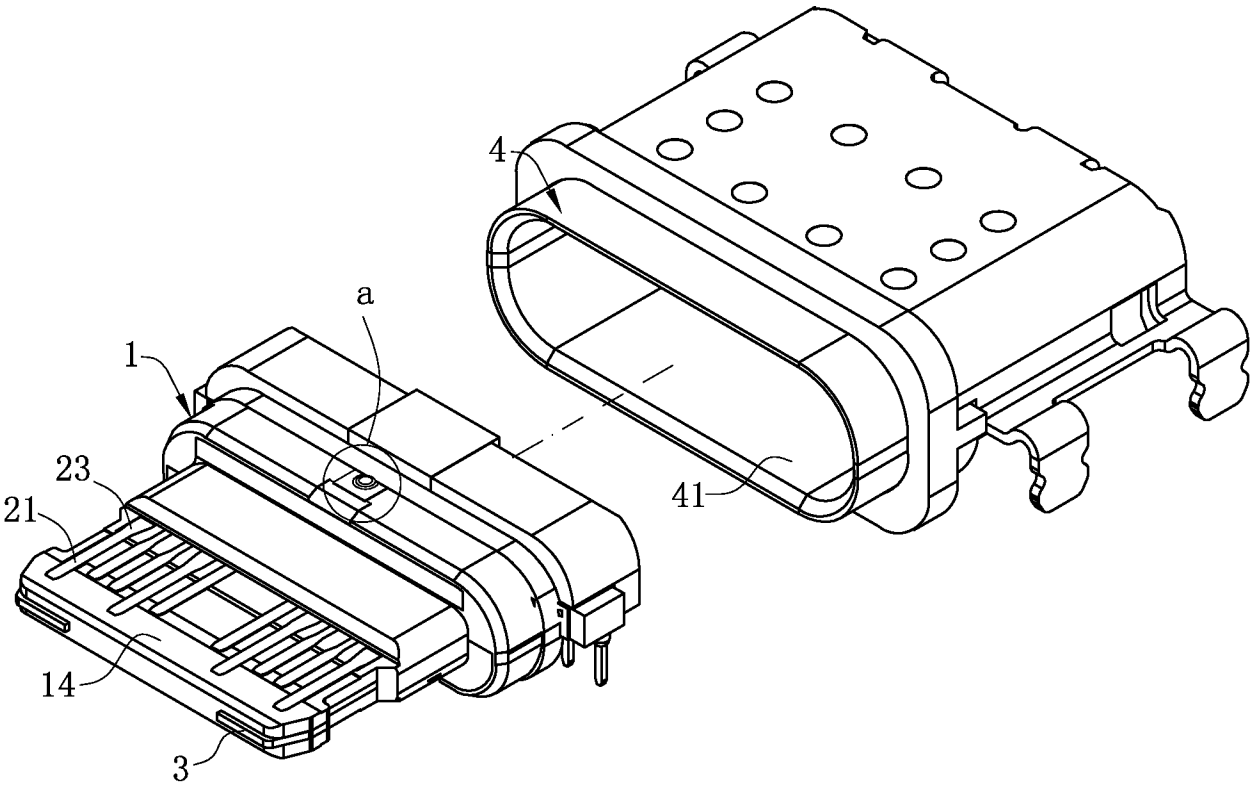
FIG. 7 is a schematic three-dimensional partial assembly view of the electrical connector of the second embodiment of the present invention.
Figure 8:
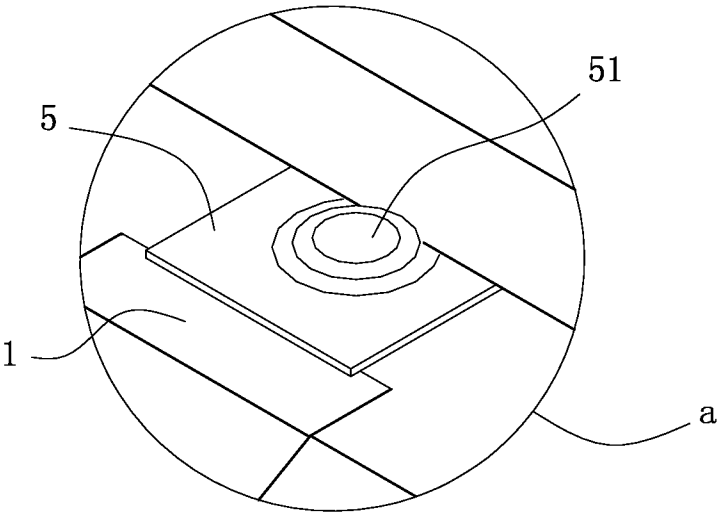
FIG. 8 is an enlarged view of part a in FIG. 7.
Figure 9:
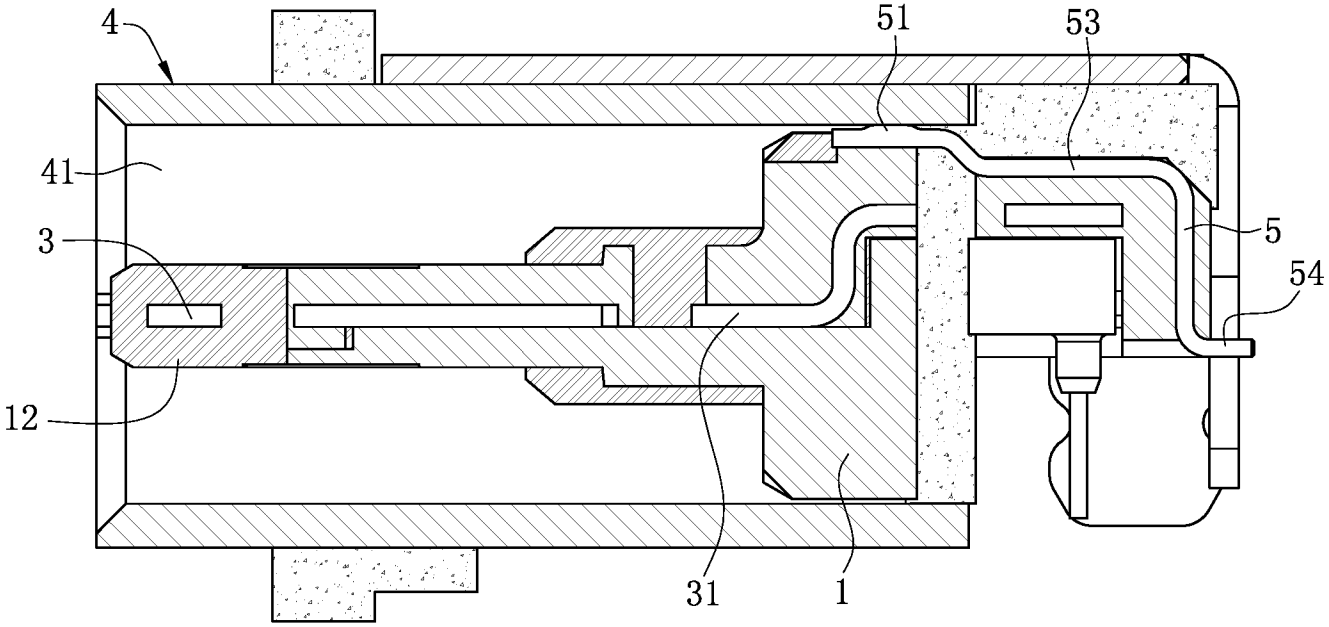
FIG. 9 is a local sectional view of the electrical connector of the second embodiment of the present invention.

FIGS. 6-8 show a second embodiment of the present invention. The second embodiment is different from the first embodiment in that: the insulating body 1 is provided with a base 11, a tongue 14 extends from one side of the base 11, the first contacting portions 211 are exposed upwardly at the tongue 14, and the second contacting portions 221 are exposed downwardly at the tongue 14; the base 11 is provided with a groove 114, the third contacting portion 51 is exposed in the groove 114 and urges against the shielding shell 4 (as shown in FIG. 9), and detailed description is not made here.

In summary, the electrical connector according to certain embodiments of the present invention, among other things, has the following beneficial advantages:

(1) The present invention arranges the ground member 5 between the two adjacent first terminals 21 or the two adjacent second terminals 22, the ground member 5 is provided with the third contacting portion 51, the third contacting portion 51 only urges against the shielding shell 4. Consequently, a ground portion is added, the grounding area is enlarged, the grounding effect of the electrical connector is enhanced, electromagnetic interference is decreased, and the high-frequency transmission performance of the electrical connector is guaranteed.

(2) The rear pins 53 are provided with the third soldering portions 54 that extend backward out of the insulating body 1, the third soldering portions 54 are soldered on a circuit board, the ground member 5 is grounded by means of the third soldering portions 54, and thereby the grounding effect of the electrical connector is enhanced.

(3) The width of the ground member 5 is greater than or equal to the sum of the widths of the two first terminals 21 or the sum of the widths of the two second terminals 22, the width of the ground member 5 can be greater under the condition that the specification of the upper board 12, the lower board 13 or the tongue 14 comes up to standard, so that the grounding area is further enlarged, and thereby the grounding effect of the electrical connector is enhanced.

(4) The insulating body 1 is concavely provided with a through hole 111 in the base 11, the third contacting portion 51 is formed by upwardly raising from the ground member 5, the third contacting portion 51 upwardly or downwardly goes beyond the first terminal group 23 or the second terminal group 24, the third contacting portion 51 is exposed in the through hole 111, the first elastic piece 42 extends into the insertion space 41 from the shielding shell 4, the first elastic piece 42 is located in the through hole 111 and abuts against the third contacting portion 51, the third contacting portion 51 is upwardly raised to be exposed in the through hole 111, so that the shielding shell 4 can be more easily contacted with the ground member 5, consequently, the ground portion and grounding area of the ground member 5 are enlarged, and the grounding effect of the electrical connector is enhanced.

(5) The stopping portion 43 extends toward the base 11 from the shielding shell 4, the stopping portion 43 is located in the positioning slot 112 to stop the forward and backward displacement of the insulating body 1, and thereby the insulating body 1 can be fixed more steadily.

(6) The two shielding plates 6 are respectively exposed upwardly at the upper board 12 and exposed downwardly at the lower board 13 to shield outside signal interference on the signal terminals, so that a shielding structure is formed to guarantee the high-frequency transmission performance of the electrical connector.

(7) Each shielding plate 6 is pierced between each two adjacent second elastic pieces 61, so that the contacting arm 62 which extends backward is formed, the contacting arms 62 urge against the shielding shell 4, so that the shielding plates 6 are grounded by means of the shielding shell 4, and thereby the grounding effect of the electrical connector is enhanced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for a mating connector to be inserted therein, comprising:

an insulating body;

a shielding shell wrapping the insulating body to form an insertion space, the insertion space being configured for the mating connector to be inserted therein; and a first terminal group and a second terminal group, respectively fixed in an upper row and a lower row in the insulating body, wherein the first terminal group and the second terminal group are provided respectively with a plurality of first terminals and a plurality of second terminals, each of the first terminals and each of the second terminal are provided respectively with a first contacting portion and a second contacting portion, the first contacting portions and the second contacting portions are exposed in the insertion space;

wherein a ground member is arranged between two adjacent first terminals or two adjacent second terminals, the ground member is arranged in a row along with the first terminals or the second terminals, the ground member has a third contacting portion, and the third contacting portion only urges against the shielding shell;

wherein two rear pins extend backward from the third contacting portion of the ground member, and each rear pin is provided with a third soldering portion that extends backward out of the insulating body; and wherein each of the first terminals has a first soldering portion that extends out of the insulating body, each of the second terminals has a second soldering portion that extends out of the insulating body, the third soldering portions are located between two adjacent first soldering portions or two adjacent second soldering portions, and the third soldering portions are arranged in a row along with the first soldering portions or the second soldering portions.

2. The electrical connector of claim 1, wherein the insulating body is provided with a through hole, the third contacting portion is exposed in the through hole, a first elastic piece extends into the insertion space from the shielding shell, and the first elastic piece is located in the through hole and urges against the third contacting portion.

3. The electrical connector of claim 2, wherein the third contacting portion is formed by protruding upward from the ground member, and the third contacting portion goes upward or downward beyond the first terminal group or the second terminal group.

4. The electrical connector of claim 1, wherein reserved terminals, power terminals, differential pair terminals and ground terminals are respectively arranged in sequence on both sides of the ground member, and the reserved terminals are adjacent to the ground member.

5. The electrical connector of claim 1, wherein a width of the ground member is greater than or equal to a sum of widths of the two first terminals or the sum of the widths of the two second terminals.

6. The electrical connector of claim 1, wherein the ground member is fixed in the insulating body and is not exposed in the insertion space.

7. The electrical connector of claim 1, wherein two front pins extend forward from the third contacting portion of the ground member, and the front pins do not extend forward out of the insulating body.

8. The electrical connector of claim 1, wherein the insulating body is provided with a base, a stopping portion extends toward the base from the shielding shell, the base is recessed with a positioning slot corresponding to the stopping portion, and the stopping portion is located in the positioning slot.

9. The electrical connector of claim 1, wherein the insulating body is provided with a base, an upper board and a lower board extend from one side of the base, the upper board and the lower board are located in the insertion space, the first contacting portions are exposed downward at the upper board, and the second contacting portions are exposed upward at the lower board.

10. The electrical connector of claim 9, wherein front ends of the upper board and the lower board are provided respectively with at least one hole, the holes communicate with the insertion space, at least one shielding plate is respectively exposed upward at the upper board and exposed downward at the lower board, and the shielding plate has at least one second elastic piece that runs through the hole and is exposed in the insertion space.

11. The electrical connector of claim 10, wherein the shielding plate is located between two adjacent second elastic pieces and pierced, so that a contacting arm which extends backward is formed, and the contacting arm urges against the shielding shell.

12. The electrical connector of claim 11, wherein the shielding plate is recessed with an accommodating slot, and an insulating sheet is located in the accommodating slot.

13. The electrical connector of claim 1, further comprising a middle shielding sheet located between the first terminal group and the second terminal group, the middle sheet has a main body portion, two buckling arms extending from both sides of the main body portion and located on the both sides of the insulating body, and a hooking portion transversely extending from a front end of each of the buckling arms and exposed in the insertion space.

14. The electrical connector of claim 1, wherein the insulating body is provided with a base, a tongue extends from one side of the base, the first contacting portions are exposed upward at the tongue, and the second contacting portions are exposed downward at the tongue, the base is recessed with a groove, and the third contacting portion is exposed in the groove and urges against the shielding shell.

15. An electrical connector for a mating connector to be inserted therein, comprising:

an insulating body;

a shielding shell wrapping the insulating body to form an insertion space, the insertion space being configured for the mating connector to be inserted therein; and a first terminal group and a second terminal group, respectively fixed in an upper row and a lower row in the insulating body, wherein the first terminal group and the second terminal group are provided respectively with a plurality of first terminals and a plurality of second terminals, each of the first terminals and each of the second terminal are provided respectively with a first contacting portion and a second contacting portion, the first contacting portions and the second contacting portions are exposed in the insertion space;

wherein a ground member is arranged between two adjacent first terminals or two adjacent second terminals, the ground member is arranged in a row along with the first terminals or the second terminals, the ground member has a third contacting portion, and the third contacting portion only urges against the shielding shell;

wherein the insulating body is provided with a base, an upper board and a lower board extend from one side of the base, the upper board and the lower board are located in the insertion space, the first contacting portions are exposed downward at the upper board, and the second contacting portions are exposed upward at the lower board;

wherein front ends of the upper board and the lower board are provided respectively with at least one hole, the holes communicate with the insertion space, at least one shielding plate is respectively exposed upward at the upper board and exposed downward at the lower board, and the shielding plate has at least one second elastic piece that runs through the hole and is exposed in the insertion space; and wherein the shielding plate is located between two adjacent second elastic pieces and pierced, so that a contacting arm which extends backward is formed, and the contacting arm urges against the shielding shell.

16. The electrical connector of claim 15, wherein the shielding plate is recessed with an accommodating slot, and an insulating sheet is located in the accommodating slot.

17. The electrical connector of claim 15, further comprising a middle shielding sheet located between the first terminal group and the second terminal group, the middle sheet has a main body portion, two buckling arms extending from both sides of the main body portion and located on the both sides of the insulating body, and a hooking portion transversely extending from a front end of each of the buckling arms and exposed in the insertion space.

18. The electrical connector of claim 15, wherein the ground member is fixed in the insulating body and is not exposed in the insertion space, and the ground member is not mated with the mating connector.

19. The electrical connector of claim 15, wherein:

at least one front pin extends forward from the third contacting portion of the ground member, at least one rear pin extends backward from the third contacting portion of the ground member, the at least one front pin does not extend forward out of the insulating body, and the at least one rear pin is provided with a third soldering portion that extends backward out of the insulating body; and each of the first terminals has a first soldering portion that extends out of the insulating body, each of the second terminals has a second soldering portion that extends out of the insulating body, the third soldering portion is located between two adjacent first soldering portions or two adjacent second soldering portions, and the third soldering portion is arranged in a row along with the first soldering portions or the second soldering portions.

* * * * *